US009563143B2

(12) United States Patent
Kosasa

(10) Patent No.: US 9,563,143 B2
(45) Date of Patent: Feb. 7, 2017

(54) IMAGE FORMATION APPARATUS AND METHOD OF CONTROLLING IMAGE FORMATION APPARATUS THAT UTILIZES MISREGISTRATION AMOUNT DETECTION PATTERNS

(71) Applicant: Oki Data Corporation, Tokyo (JP)

(72) Inventor: Tsutomu Kosasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 49 days.

(21) Appl. No.: 14/251,864

(22) Filed: Apr. 14, 2014

(65) Prior Publication Data

US 2014/0321889 A1 Oct. 30, 2014

(30) Foreign Application Priority Data

Apr. 26, 2013 (JP) ..... 2013-094261

(51) Int. Cl.
*G03G 15/01* (2006.01)
*G03G 15/00* (2006.01)

(52) U.S. Cl.
CPC ..... *G03G 15/0131* (2013.01); *G03G 15/0178* (2013.01); *G03G 15/5062* (2013.01); *G03G 15/55* (2013.01); *G03G 2215/0141* (2013.01); *G03G 2215/0161* (2013.01)

(58) Field of Classification Search
CPC ..... G03G 2215/0158; G03G 2215/0161
See application file for complete search history.

(56) References Cited

U.S. PATENT DOCUMENTS 5,298,917 A * 3/1994 Deguchi ..... G03G 21/1633 347/138
2004/0052554 A1* 3/2004 Harada ..... G03G 15/0194 399/301
2009/0141298 A1* 6/2009 Kushida ..... G03G 15/0194 358/1.12
2012/0163880 A1* 6/2012 Kuroki ..... G03G 15/5058 399/301

FOREIGN PATENT DOCUMENTS

JP 2001-134041 A 5/2001
JP 2012063499 A * 3/2012

* cited by examiner

*Primary Examiner* — Clayton E Laballe
*Assistant Examiner* — Victor Verbitsky
(74) *Attorney, Agent, or Firm* — Mots Law, PLLC

(57) ABSTRACT

An image formation method includes: a first image formation misregistration correction processing that causes each image formation unit to form a misregistration amount detection pattern, obtains an image formation misregistration amount by detecting the patterns, and corrects an image formation misregistration based on the obtained image formation misregistration amount; comparison processing that compares a previous image formation misregistration amount with a latest image formation misregistration amount; and a second image formation misregistration correction processing that causes each image formation unit to form new misregistration amount detection patterns, obtains a new image formation misregistration amount by detecting the new patterns and corrects the image formation misregistration based on the obtained new image formation misregistration amount when receiving a new print job and if a difference between the previous image formation misregistration amount and the latest image formation misregistration amount is larger than a predetermined value.

12 Claims, 14 Drawing Sheets

IMAGE FORMATION APPARATUS AND METHOD OF CONTROLLING IMAGE FORMATION APPARATUS THAT UTILIZES MISREGISTRATION AMOUNT DETECTION PATTERNS

CROSS REFERENCE TO RELATED APPLICATIONS

This application claims priority based on 35 USC 119 from prior Japanese Patent Application No. 2013-094261 filed on Apr. 26, 2013, entitled "IMAGE FORMATION APPARATUS AND METHOD OF CONTROLLING IMAGE FORMATION APPARATUS", the entire contents of which are incorporated herein by reference.

BACKGROUND OF THE INVENTION

1. Field of the Invention

This disclosure relates to an image formation apparatus and a method of controlling the image formation apparatus, and is applicable to an MFP (Multi Function Printer) including an electrophotographic color printer unit and a scanner unit, for example.

2. Description of Related Art

In image formation apparatuses to perform electrophotographic color image formation in a color printer, a color copying machine, a color MFP and the like, multiple independent image formation units are detachably provided, one after another, along a conveyance belt to convey a recording medium. Each of the image formation units mounted in the conventional image formation apparatus includes a photosensitive drum. Toner images of respective colors are formed on the photosensitive drums and are sequentially transferred in a superimposed manner onto the medium to form a color image.

In the conventional image formation apparatus as described above, a dimensional error, misalignment of mounting positions or the like of the image formation units causes misregistration in print position (superimposed position) among the toner images of the respective colors in the formed color image (hereinafter referred to as a "color misregistration", "print misregistration" or "image formation misregistration"). This leads to a problem of deterioration in image quality. To solve this problem, the conventional image formation apparatus as described above includes a color misregistration correction processing unit to correct a misregistration in print position between the colors.

In the image formation apparatus, the color misregistration as described above may occur after the apparatus receives shocks by opening and closing of a cover due to jamming of a medium (e.g., paper conveyance failure or the like). The conventional image formation apparatus capable of color misregistration correction processing, for example, detects opening and closing operations of the cover and executes color misregistration correction in response to the closing of the cover.

As a color misregistration correction method for the conventional image formation apparatus, there has been known a method in which color misregistration detection patterns formed on photosensitive drums are transferred onto a medium conveyance belt, and a print start position of each color is corrected according to a color misregistration amount detected by a unit configured to detect the color misregistration amount among colors in the detection pattern transferred onto the belt. This print start position correction is executed every time the power is turned on, the cover is opened or closed, or a given number of sheets are printed (see, for example, Patent Document 1: Japanese Patent Application Publication No. 2001-134041).

SUMMARY OF THE INVENTION

However, the quality of printed images (image quality) is deteriorated when the correction is insufficient, for example.

An object of an embodiment of the invention is to improve the quality of printed images.

A first aspect of the invention is an image formation apparatus that includes: an image formation section including image formation units configured to form images on a medium; and a mechanism controller configured to control the image formation section and cause the image formation section to perform image formation. The mechanism controller performs: image formation misregistration amount detection processing of causing each of the image formation units in the image formation section to form a misregistration amount detection pattern and obtaining a first image formation misregistration amount based on a detection result obtained using the patterns; comparison processing of comparing a previous image formation misregistration amount with a latest image formation misregistration amount; and image formation misregistration correction processing of causing each of the image formation units in the image formation section to form a misregistration amount detection pattern, and obtaining a second image formation misregistration amount based on a detection result obtained using the patterns, and correcting the image formation misregistration according to the second image formation misregistration amount in execution of printing when a difference between the previous image formation misregistration amount and the latest image formation misregistration amount is larger than a predetermined value, or alternatively, correcting the image formation misregistration according to the first image formation misregistration amount when the difference between the previous image formation misregistration amount and the latest image formation misregistration amount is not more than the predetermined value.

A second aspect of the invention is a method of performing image formation using an image formation section including image formation units configured to form images on a medium. The method includes: image formation misregistration amount detection processing of forming a misregistration amount detection pattern using the image formation section and obtaining a first image formation misregistration amount based on a detection result obtained using the formed pattern; comparison processing of comparing a previous image formation misregistration amount with a latest image formation misregistration amount; and image formation misregistration correction processing of forming a misregistration amount detection pattern using the image formation section, obtaining a second image formation misregistration amount based on a detection result obtained using the pattern and either (a) correcting the image formation misregistration according to the second image formation misregistration amount in execution of printing when a difference between the previous image formation misregistration amount and the latest image formation misregistration amount is larger than a predetermined value, or (b) correcting the image formation misregistration according to the first image formation misregistration amount when the difference between the previous image formation misregistration amount and the latest image formation misregistration amount is not more than the predetermined value.

According to the above aspects of the invention, printed image quality can be improved.

DETAILED DESCRIPTION OF EMBODIMENTS

Figure 1:
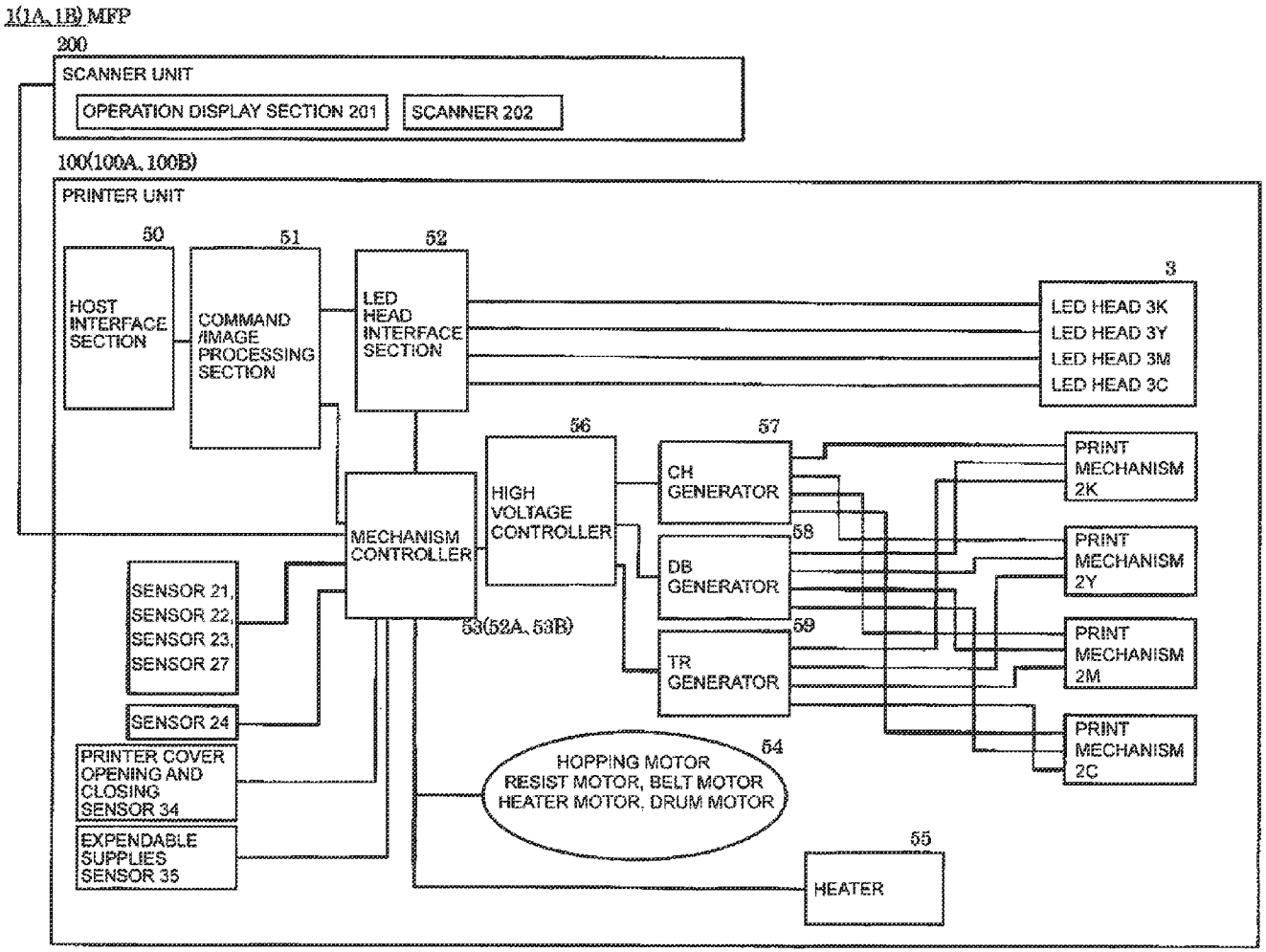
FIG. 1 is a block diagram illustrating a configuration of a control system of an MFP according to a first embodiment.

Descriptions are provided hereinbelow for embodiments based on the drawings. In the respective drawings referenced herein, the same constituents are designated by the same reference numerals and duplicate explanation concerning the same constituents is omitted.

All of the drawings are provided to illustrate the respective examples only.

(A) First Embodiment

With reference to the drawings, a detailed description is given below of a first embodiment of an image formation apparatus and a method of controlling the image formation apparatus according to the invention. Note that, in the first embodiment, the description is given of an example where the image formation apparatus of the invention is applied to an MFP.

(A-1) Configuration of First Embodiment

Figure 4:
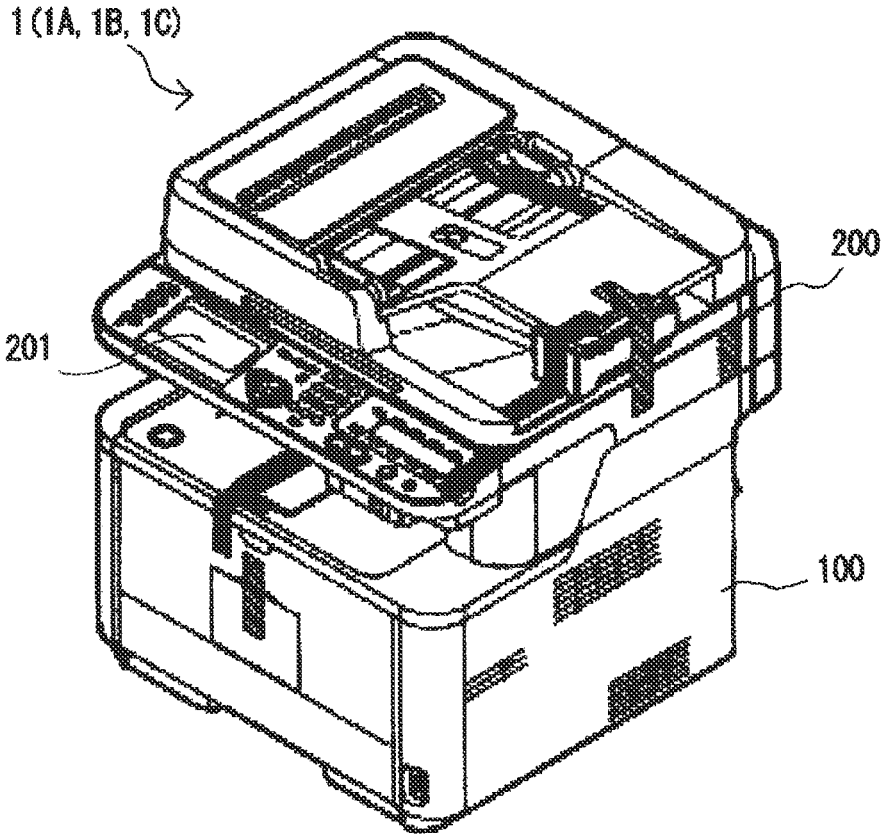
FIG. 4 is a perspective view of the MFP according to the first embodiment (Part 1, printer cover: closed, scanner unit: closed).
Figure 5:
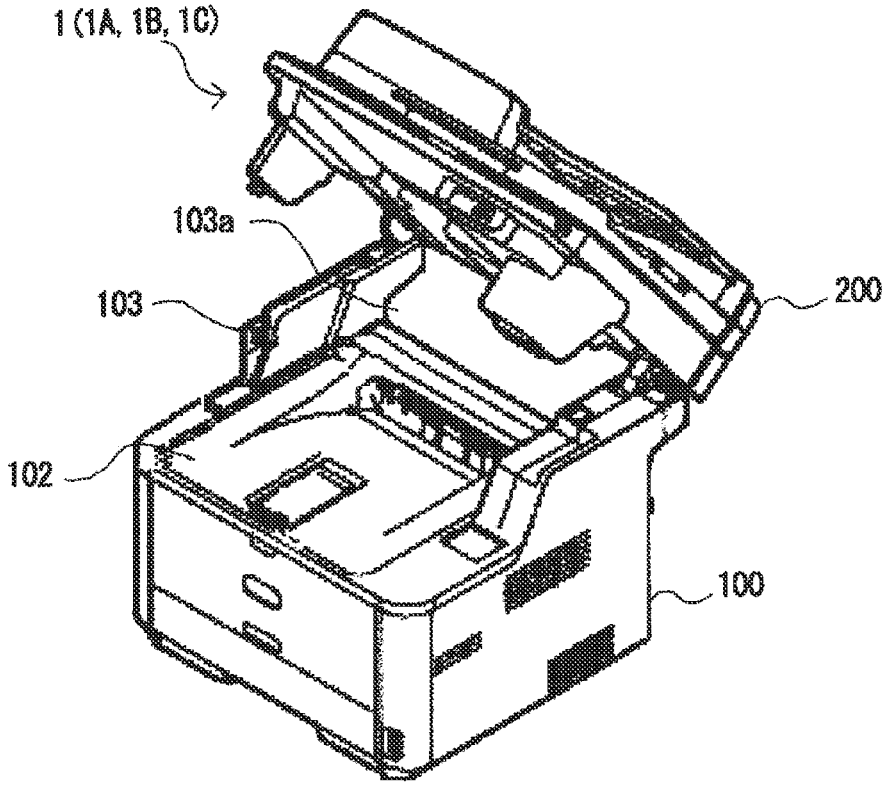
FIG. 5 is a perspective view of the MFP according to the first embodiment (Part 2, printer cover: closed, scanner unit: open).
Figure 6:
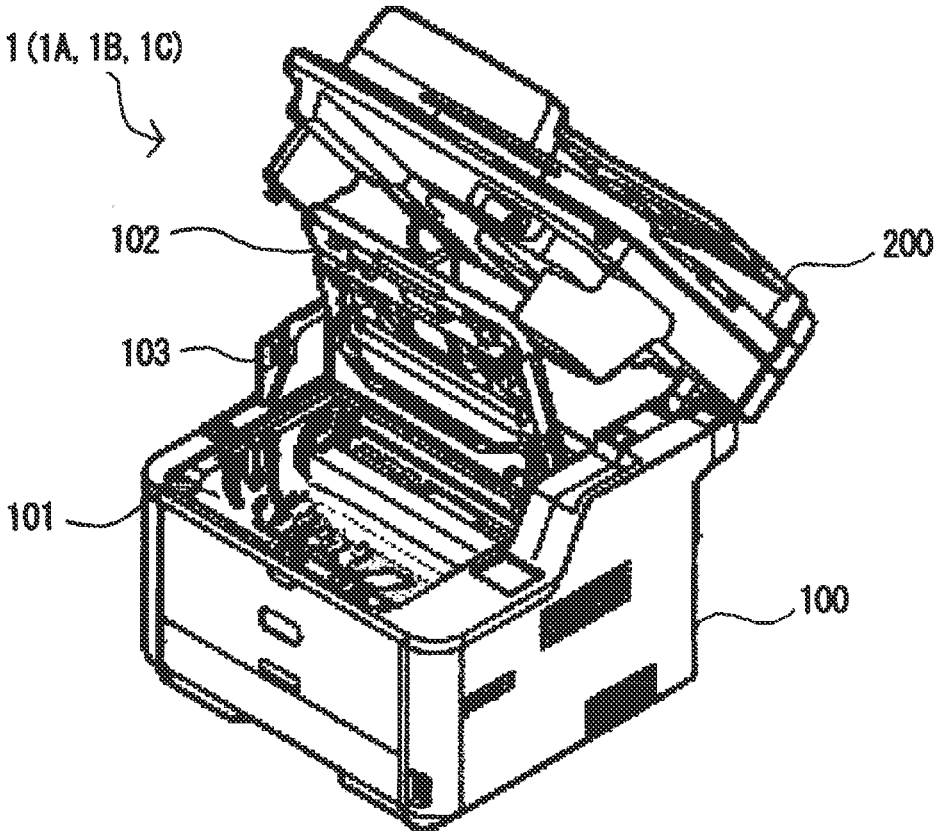
FIG. 6 is a perspective view of the MFP according to the first embodiment (Part 3, printer cover: open, scanner unit: open).

FIGS. 4 to 6 are external perspective views of MFP 1000, respectively.

In terms of hardware, MFP 1000 mainly includes: printer unit 100 as an image formation unit configured to perform processing of the printing of an image on a medium, and the like; and scanner unit 200 configured to perform processing of the reading of a document, and the like.

As illustrated in FIG. 6, opening 101 through which a print mechanism (image formation unit) to be described later can be accessed is provided in an upper surface of printer unit 100. In printer unit 100, printer cover 102 is provided as a first opening and closing body that can be opened and closed in opening 101. FIG. 6 is a perspective view of MFP 1000 when printer cover 102 is open. On the other hand, FIGS. 4 and 5 are perspective views of MFP 1000 when printer cover 102 is closed.

Also, in printer unit 100, support unit 103 having a U-shape in a planar view is provided around opening 101 (printer cover 102) as illustrated in FIGS. 5 and 6. Support unit 103 supports scanner unit 200. Scanner unit 200 is disposed so as to cover an upper surface of support unit 103. Also, scanner unit 200 is connected (e.g., connected by an unillustrated hinge or the like) to support unit 103 so as to be able to open and close opening 103*a* in an upper surface portion of support unit 103, as illustrated in FIGS. 4 and 5. FIGS. 5 and 6 are perspective views of MFP 1000 when scanner unit 200 is open. On the other hand, FIG. 4 is a perspective view of MFP 1000 when scanner unit 200 is closed. Note that it is assumed that printer unit 100 and printer cover 102 are electrically connected to each other by an unillustrated electrical connector or the like and that scanner unit 200 is operated by the control of printer unit 100 or control of a power supply. In MFP 1000, as described above, scanner unit 200 itself is disposed as a second opening and closing body that can be accessed even when printer cover 102 is closed.

Next, a description is given of an overview of a hardware configuration in printer unit 100.

Figure 2:
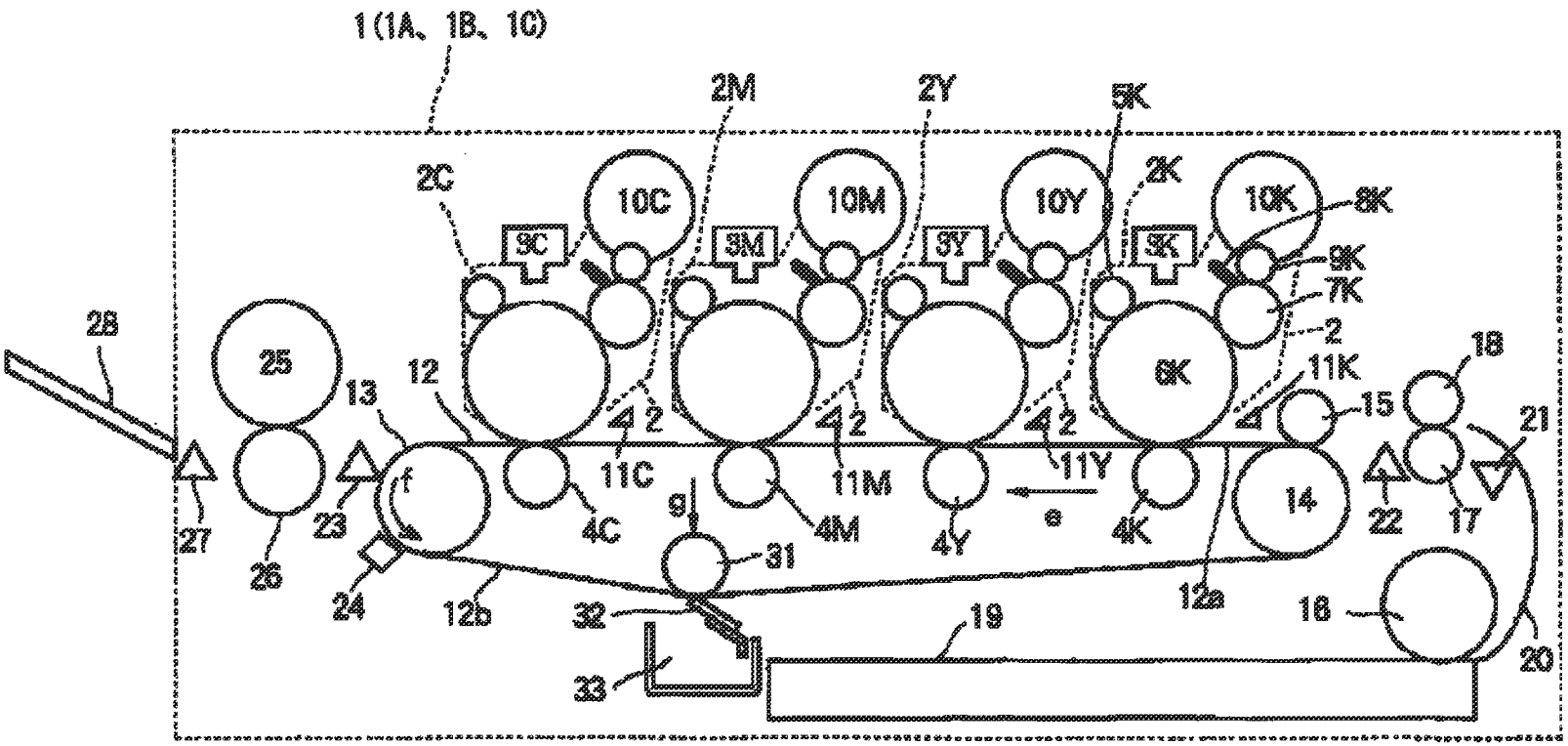
FIG. 2 is a schematic sectional side view of the MFP according to the first embodiment.

FIG. 2 is a schematic sectional side view of printer unit 100.

In FIG. 2, printer unit 100 includes four independent print mechanisms (image drum units and image formation units) 2K, 2Y, 2M and 2C disposed along a conveyance path from an insertion side of a recording medium toward a discharge side thereof. Although print mechanisms 2K, 2Y, 2M and 2C may be arranged in random order, the arrangement order thereof here is 2K, 2Y, 2M and 2C from the insertion side of the recording medium toward the discharge side thereof for the convenience of the following description.

Print mechanisms 2K to 2C are electrophotographic LED print mechanisms for recording images of black K, yellow Y, magenta M and cyan C. All print mechanisms 2K to 2C have the same configuration that includes an image formation unit 2 with LED head 3 configured to expose a photoreceptor according to image data and transfer rollers 4K to 4C, respectively, configured to transfer a toner image onto the recording medium. FIG. 2 omits the illustration of some reference numerals to avoid redundancy. However, each of image formation units 2 includes LED head 3 configured to form an electrostatic latent image, charging roller 5, photoreceptor 6 having a surface uniformly charged by charging roller 5, development roller 7 included in a development unit to form a toner image, development blade 8, sponge roller 9, toner cartridge 10, and the like.

First, a description is given of an image formation using a black toner in print mechanism 2K. The toner supplied from toner cartridge 10K reaches development blade 8K via sponge roller 9K. The toner is formed into a thin layer on a circumferential surface of development roller 7K, and then reaches a contact surface with photoreceptor 6K. The toner is friction-charged through strong friction with development roller 7K and development blade 8K during the thin layer formation. Sponge roller 9K allows development blade 8K to carry an adequate amount of toner.

Although not illustrated in detail, LED head 3K includes an LED array, a drive IC configured to drive the LED array, a substrate with a resistor group holding print data and the like, and a lens array configured to collect light from the LED array. In LED head 3K, the surface of photoreceptor 6K is exposed to light emitted by the LED array in response to an image data signal inputted from an interface unit, and thus an electrostatic latent image can be formed thereon. Electrostatic force causes the toner to move from the circumferential surface of development roller 7K and adhere to the electrostatic latent image on photoreceptor 6K, thereby forming a toner image corresponding to the print data. Conveyance belt 12 to be described later is movably provided between photoreceptor 6K and transfer roller 4K.

Print mechanisms 2Y to 2C of yellow, magenta and cyan all have the same configuration as that of print mechanism 2K of black. Conveyance belt 12 is movably provided between respective photoreceptors 6 and transfer rollers 4Y to 4C. Toner cartridge 10K in print mechanism 2K contains a black (K) toner, toner cartridge 10Y in print mechanism 2Y contains an yellow (Y) toner, toner cartridge 10M in print mechanism 2M contains a magenta (M) toner, and toner cartridge 10C in print mechanism 2C contains a cyan (C) toner.

A black image signal among color image signals is inputted to LED head 3K in print mechanism 2K, an yellow image signal among the color image signals is inputted to LED head 3Y in print mechanism 2Y, a magenta image signal among the color image signals is inputted to LED head 3M in print mechanism 2M, and a cyan image signal among the color image signals is inputted to LED head 3C in print mechanism 2C. Also, neutralization light sources 11K, 11Y, 11M and 11C for neutralization of the photoreceptor surfaces are attached between the development units and transfer units in respective print mechanisms 2K to 2C.

Conveyance belt 12 is made of a high-resistance semiconductive plastic film formed in an endless and seamless shape, and is wound around drive roller 13 and driven roller 14. Drive roller 13 is connected to an unillustrated belt motor and rotated in the arrow f direction by the motor. An upper portion of conveyance belt 12 is spanned between respective photoreceptors 6 and transfer rollers 4K to 4C in print mechanisms 2K to 2C.

Moreover, a paper feed mechanism to feed paper onto the conveyance path is provided on the lower right side of printer unit 100 in FIG. 2. This paper feed mechanism includes hopping roller 16, resist roller 17 and paper housing cassette 19. Paper S (medium) that is a recording medium housed in paper housing cassette 19. Sheets of paper S are selected one by one by an unillustrated discriminator, taken out by hopping roller 16, and then guided by guide 20 to reach resist roller 17. Here, when a paper S is fed askew, the skew of paper S is corrected by resist roller 17 and opposing pinch roller 18. Then, paper S is guided from resist roller 17 into between suction roller 15 and conveyance belt 12. Suction roller 15 charges paper S while pressing paper S with driven roller 14 so that paper S is electrostatically adsorbed on the upper surface of conveyance belt 12.

Reference numerals 21 and 22 denote sensors to detect paper S, which are disposed in front of and behind resist roller 17, respectively. To the left of conveyance belt 12 on the drive roller 13 side, sensor 23 is provided to check a paper S that has failed to separate from conveyance belt 12 or to detect a rear end position of paper S. Moreover, below drive roller 13, reflection intensity detection mechanism 24 is provided facing conveyance belt 12 at a predetermined rotation angle position of drive roller 13. This reflection intensity detection mechanism 24 includes an unillustrated light-emitting element and a light-receiving element. Reflection intensity detection mechanism 24 can produce an output proportional to the reflection intensity of the surface of conveyance belt 12 or of a color toner printed thereon, based on the light received by the light-receiving element.

At the lower surface side of conveyance belt 12, a cleaning mechanism is provided that includes tension roller 31, cleaning blade 32 and waste toner tank 33. Tension roller 31 and cleaning blade 32 are provided at positions facing each other so as to sandwich the lower half portion 12*b* of conveyance belt 12 in-between. Tension roller 31 presses down conveyance belt 12 in the arrow g direction. Cleaning blade 32 is made of a flexible rubber material or plastic material and can scrape off into waste toner tank 33 the toner that adheres to and remains on the surface of upper half portion 12*a* of conveyance belt 12.

Figure 3A:
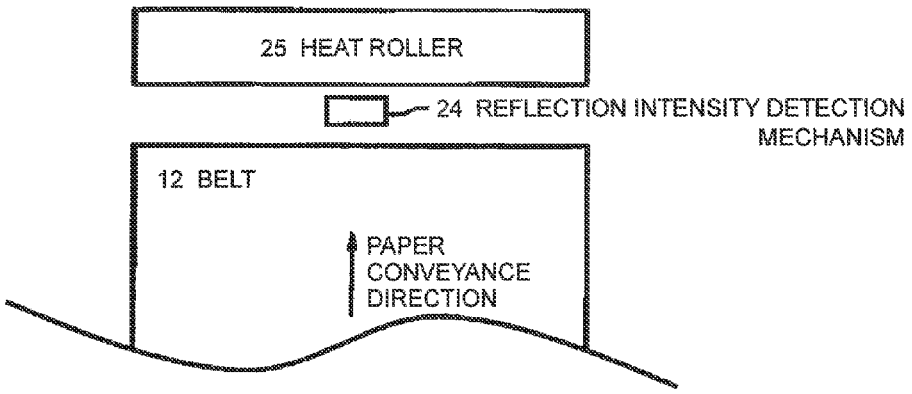
FIGS. 3A and 3B are explanatory diagrams each illustrating a mounting position(s) of a reflection intensity detection mechanism(s) included in a printer unit according to the first embodiment.
Figure 3B:
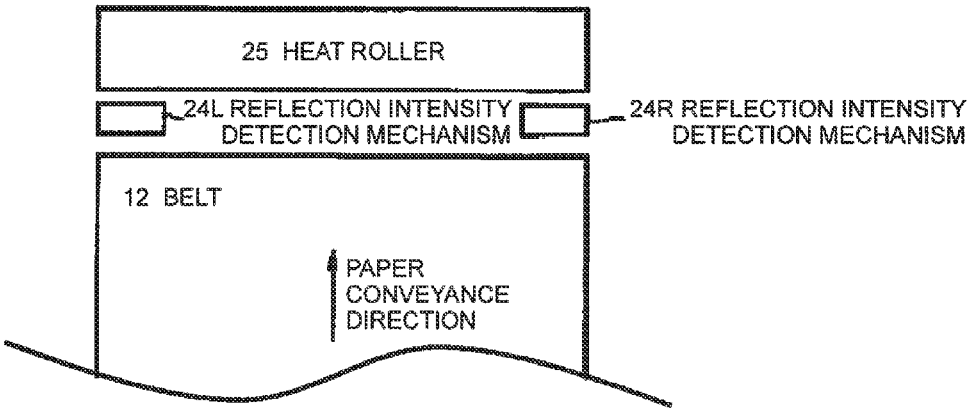

FIGS. 3A and 3B are schematic plan views that illustrate mounting positions of reflection intensity detection mechanism 24 described above. FIGS. 3A and 3B show the mounting positions of reflection intensity detection mechanism 24 to detect a color misregistration in an arrangement direction of recording elements such as LEDs (main scanning direction) and in a conveyance direction of conveyance belt 12 (sub-scanning direction). In FIG. 3A, reflection intensity detection mechanism 24 is disposed at approximately the center position in the main scanning direction relative to conveyance belt 12. In FIG. 3B, on the other hand, a pair of reflection intensity detection mechanisms 24R and 24L are disposed on a straight line perpendicular to the conveyance direction of the paper at left and right ends in the main scanning direction relative to conveyance belt 12. Furthermore, heat roller 25 illustrated in FIGS. 3A and 3B is included in a fixing mechanism to fix a toner image on a medium having the toner image transferred thereon. Note that the specific configuration of reflection intensity detection mechanism 24 is not limited to the examples illustrated in FIGS. 3A and 3B described above as long as the color misregistration in the main scanning direction and in the sub-scanning direction can be detected.

Reflection intensity detection mechanism 24 functions as a sensor to detect a misregistration in a print position (this misregistration is hereinafter referred to as a "color misregistration") in the main scanning direction and sub-scanning direction among respective print mechanisms 2K, 2Y, 2M and 2C.

In FIGS. 2, 3A and 3B, the longitudinal direction of the belt running direction is the sub-scanning direction, while the horizontal direction relative to the belt running direction is the main scanning direction. Reflection intensity detection mechanism 24 is disposed at approximately the center position in the main scanning direction relative to conveyance belt 12. Furthermore, heat roller 25 illustrated in FIGS. 2, 3A and 3B is included in the fixing mechanism to fix a toner image on paper S having the toner image transferred thereon.

The fixing mechanism is disposed further to the left of sensor 23 provided to the left of conveyance belt 12 on the drive roller 13 side as illustrated in FIG. 2. The fixing mechanism includes heat roller 25 configured to heat the toner on paper S and pressure roller 26 configured to apply pressure on paper S together with heat roller 25. Also, discharge sensor 27 is provided further to the left of heat roller 25 to monitor a jam in the fixing mechanism and the winding of paper S around heat roller 25. A discharge opening is formed to the left of discharge sensor 27, and discharge stacker 28 is provided outside the discharge opening. Printed paper S is discharged onto discharge stacker 28.

Next, a description is given of a configuration of a control system of printer unit 100.

FIG. 1 is a block diagram extracting and illustrating constituent components in a control system of MFP 1000, which are related to a function to correct a print position in the main scanning direction and sub-scanning direction among respective print mechanisms 2K, 2Y, 2M and 2C (hereinafter also referred to as a "color misregistration correction function").

In FIG. 1, reference symbols K, Y, M and C are added to represent the correspondence with image formation units 2 in respective print mechanisms 2K to 2C of black, yellow, magenta and cyan.

In FIG. 1, host interface section 50 is a part serving as a physical hierarchical interface with an unillustrated host computer, and includes a connector and a communication chip. Command/image processing section 51 interprets commands and image data received from the host computer, or develops the image data into a bit map. Command/image processing section 51 includes a microprocessor, a RAM, hardware specially designed for developing the image data into the bit map, and the like. Command/image processing section 51 performs an overall control of printer unit 100. LED head interface section 52 includes a semi-customized LSI, a RAM and the like, and processes the image data developed into the bit map by command/image processing section 51 for an interface of LED head 3.

Mechanism controller 53 controls the drive of various motors 54 while monitoring signals inputted from various sensors 21 to 23 and 27 and reflection intensity detection mechanism (hereinafter also simply referred to as the "sensor") 24 according to commands from command/image processing section 51, or controls power distribution to heater 55, thereby controlling the mechanisms in the print system and high voltage. Note that motors 54 include various motors such as a hopping motor, a resist motor, a belt motor, drum motors in print mechanisms 2K to 2C and a heater motor to activate heat roller 25 and the like as well as drivers to drive those motors, and the like. Heater 55 is a halogen lamp, for example, which is disposed inside heat roller 25. In heat roller 25, an unillustrated thermistor is disposed to control a fixing temperature.

High voltage controller 56 includes a microprocessor or a customized LSI, and controls generation of a charge voltage (CH), a developing bias (DB), transfer voltage (TR) and the like for print mechanisms 2K to 2C. CH generator 57, DB generator 58 and TR generator 59 are connected to high voltage controller 56. CH generator 57 controls the generation and stop of the charge voltage delivered to print mechanisms 2K to 2C. DB generator 58 controls the supply of the developing bias to print mechanisms 2K to 2C. TR generator 59 controls the transfer voltage applied to respective transfer rollers 4K to 4C. TR generator 59 also includes an unillustrated current/voltage detection circuit to control a constant current or a constant voltage.

MFP 1000 also includes printer cover opening and closing sensor 34 (first opening and closing sensor) to detect open and closed states of printer cover 102. While a detection method of printer cover opening and closing sensor 34 is not limited, printer cover opening and closing sensor 34 may include a detection mechanism such as a button which is set in a pressed state (ON state) when printer cover 102 is closed and set in a released state (OFF state) when printer cover 102 is opened.

MFP 1000 also includes expendable supplies sensor 35 to detect expendable supplies related to print mechanisms 2Y, 2M and 2C (e.g., for replacement of toner cartridges 10 and the like). A configuration of mechanism controller 53 to detect replacement of the expendable supplies related to print mechanisms 2Y, 2M and 2C is not limited. For example, IC tags storing identification information such as serial numbers may be attached to toner cartridges 10 of the respective colors, and expendable supplies sensor 35 may monitor the information in the IC tags and detect a replacement of the expendable supplies when a change in the identification information is found.

Moreover, in MFP 1000, operation display section 201 and scanner 202 are disposed in the upper part of scanner unit 200. Operation display section 201 receives an operation from an operator, displays information to the operator, and the like. Scanner 202 reads a document loaded by the operator. Operation display section 201 can be configured using a button (hardware button or the like) to receive operations, a display to display the status of MFP 1000 and an operation screen, and the like, for example. Operation display section 201 is connected to mechanism controller 53. In mechanism controller 53, operation display section 201 functions as an interface with the operator. Note that mechanism controller 53 may receive control information from the outside through communication via a network and the like.

Next, a detailed configuration of mechanism controller 53 is described.

Figure 7:
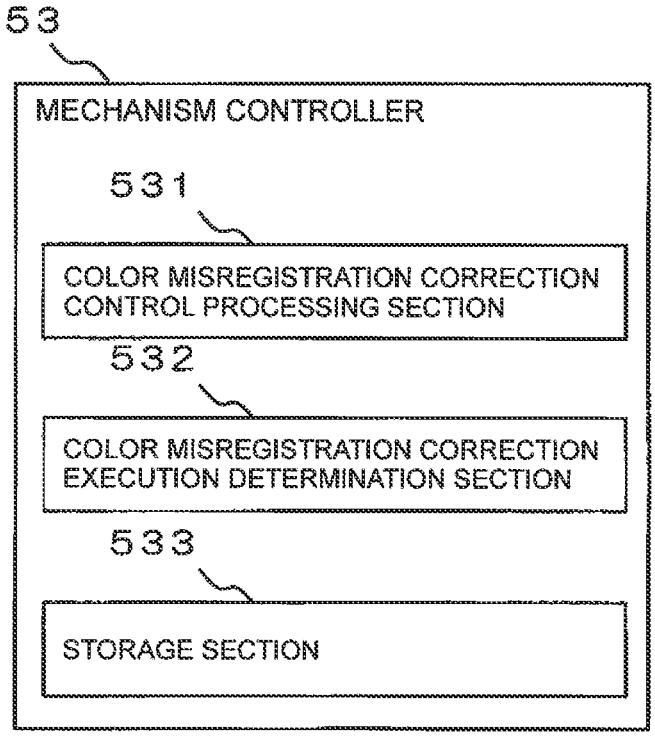
FIG. 7 is a block diagram illustrating a functional configuration of the mechanism control unit according to the first embodiment.

Mechanism controller 53 can be configured using a microprocessor, a program ROM and various interfaces. A functional configuration thereof can be illustrated as in FIG. 7. FIG. 7 is a block diagram illustrating the functional configuration of mechanism controller 53 and connections between some constituent components related to mechanism controller 53.

As illustrated in FIG. 7, mechanism controller 53 includes color misregistration correction control processing section 531, color misregistration correction execution determination section 532 and storage section 533.

Storage section 533 functions as a storage unit to store various data in mechanism controller 53 (MFP 1000). Storage section 533 is preferably a nonvolatile memory such as a flash memory. Although FIG. 7 illustrates storage section 533 as the storage unit used in mechanism controller 53, a common storage unit may be shared in MFP 1000.

Color misregistration correction control processing section 531 controls the respective constituent components, detects a color misregistration amount (at least a color misregistration amount in the main scanning direction and sub-scanning direction) of each of print mechanisms 2Y, 2M and 2C based on print mechanism 2K, and performs the process of controlling respective print mechanisms 2Y, 2M and 2C so as to enable image formation by correcting the detected color misregistration amounts (hereinafter referred to as "color misregistration correction processing").

To be more specific, color misregistration correction control processing section 531 detects the color misregistration amount by transferring an unillustrated pattern signal to a print head in each of print mechanisms 2K to 2C from LED head interface section 52, printing a detection pattern on transfer belt 12, and using reflection intensity detection mechanism 24 described above to read the print condition. For details of the detection pattern for color misregistration correction control processing section 531 to detect the color misregistration amount and specific procedures, various configurations such as the same configuration as that described in Patent Document 1 can be applied. Therefore, detailed description thereof is omitted.

While the unit of the color misregistration amount to be detected by color misregistration correction control processing section 531 is not limited, the color misregistration amount is described in this embodiment as being detected by the unit of dots (pixels) present during printing by print mechanisms 2K to 2C. More specifically, color misregistration correction control processing section 531 detects the color misregistration amount in the main scanning direction and sub-scanning direction by the unit of dots, for respective print mechanisms 2Y, 2M and 2C based on print mechanism 2K. Also, color misregistration correction control processing section 531 controls LED head interface section 52 based on the detected color misregistration amount of each of print mechanisms 2Y, 2M and 2C, thereby correcting print start timing in image formation for the detected color misregistration amount. For a detailed configuration related to color misregistration amount correction control by color misregistration correction control processing section 531, various configurations such as the same configuration as that described in Patent Document 1 can be applied. Therefore, detailed description thereof is omitted.

Hereinafter, "Xi" represents the latest color misregistration amount in the main scanning direction (hereinafter also referred to as a "horizontal direction") detected by color misregistration correction control processing section 531 for any of print mechanisms 2Y, 2M and 2C. Also, "Yi" represents the latest color misregistration amount in the sub-scanning direction (hereinafter also referred to as a "vertical direction") detected by color misregistration correction control processing section 531 for any of print mechanisms 2Y, 2M and 2C. Moreover, "X(i−1)" represents a color misregistration amount in the main scanning direction previously (immediately before Xi) detected by color misregistration correction control processing section 531 and stored in storage section 533 for any of print mechanisms 2Y, 2M and 2C. Furthermore, "Y(i−1)" represents a color misregistration amount in the sub-scanning direction previously (immediately before Yi) detected by color misregistration correction control processing section 531 and stored in storage section 533 for any of print mechanisms 2Y, 2M and 2C.

Color misregistration correction control processing section 531 allows storage section 533 to store and hold the color misregistration amounts for respective print mechanisms 2Y, 2M and 2C. However, depending on a result of comparison between the latest detected color misregistration amounts (Xi and Yi) and the color misregistration amounts (X(i−1) and Y(i−1)) previously detected and stored in storage section 533, color misregistration correction control processing section 531 discards the latest color misregistration amounts (Xi and Yi) without storing them in storage section 533. To be more specific, for example, color misregistration correction control processing section 531 assigns the latest detected color misregistration amounts (Xi and Yi) and the previously detected color misregistration amounts (X(i−1) and Y(i−1)) to the following logical formula (1), and determines whether or not logical formula (1) holds (whether or not the logical formula evaluates to True).

In formula (1), Thx and Thy are constants (integers of any value) previously set in mechanism controller 53. Note that Thx may equal Thy. Logical formula (1) evaluates to True if an absolute value "|Xi−X(i−1)|" of a difference between Xi and X(i−1) is larger than Thx, or if an absolute value "|Yi-Y(i−1)|" of a difference between Yi and Y(i−1) is larger than Thy. Otherwise logical formula (1) evaluates to False.

$$(|Xi-X(i-1)|>Thx) \vee (|Yi-Y(i-1)|>Thy) \quad (1)$$

Then, color misregistration correction control processing section 531 discards the latest detected color misregistration amounts (Xi and Yi) for all print mechanisms 2Y, 2M and 2C without storing in storage section 533 if logical formula (1) evaluates to True for at least one of print mechanisms 2Y, 2M and 2C (i.e., when the color misregistration amount is not less than a predetermined threshold). On the other hand, color misregistration correction control processing section 531 stores the latest detected color misregistration amounts (Xi and Yi) for all print mechanisms 2Y, 2M and 2C in storage section 533 if logical formula (1) evaluates to False for all print mechanisms 2Y, 2M and 2C.

When storing the color misregistration amounts (Xi and Yi) for print mechanisms 2Y, 2M and 2C in storage section 533, color misregistration correction control processing section 531 stores and holds correction details (correction control signal to be supplied to LED head interface section 52) corresponding to the color misregistration amounts in storage section 533.

Color misregistration correction execution determination section 532 performs a processing for determining when to start the color misregistration correction processing by color misregistration correction control processing section 531 (hereinafter referred to as "color misregistration correction start determination processing"). The color misregistration correction start determination processing to be performed by color misregistration correction execution determination section 532 is described in detail later.

In MFP 1000, as described above, an image formation misregistration correction unit, a storage unit, a first correction control unit, a comparison unit and a second correction control unit are configured using mechanism controller 53 and the like.

(A-2) Operations of First Embodiment

Next, a description is given of operations of MFP 1000 of the first embodiment having the configuration as described above.

Figure 8:
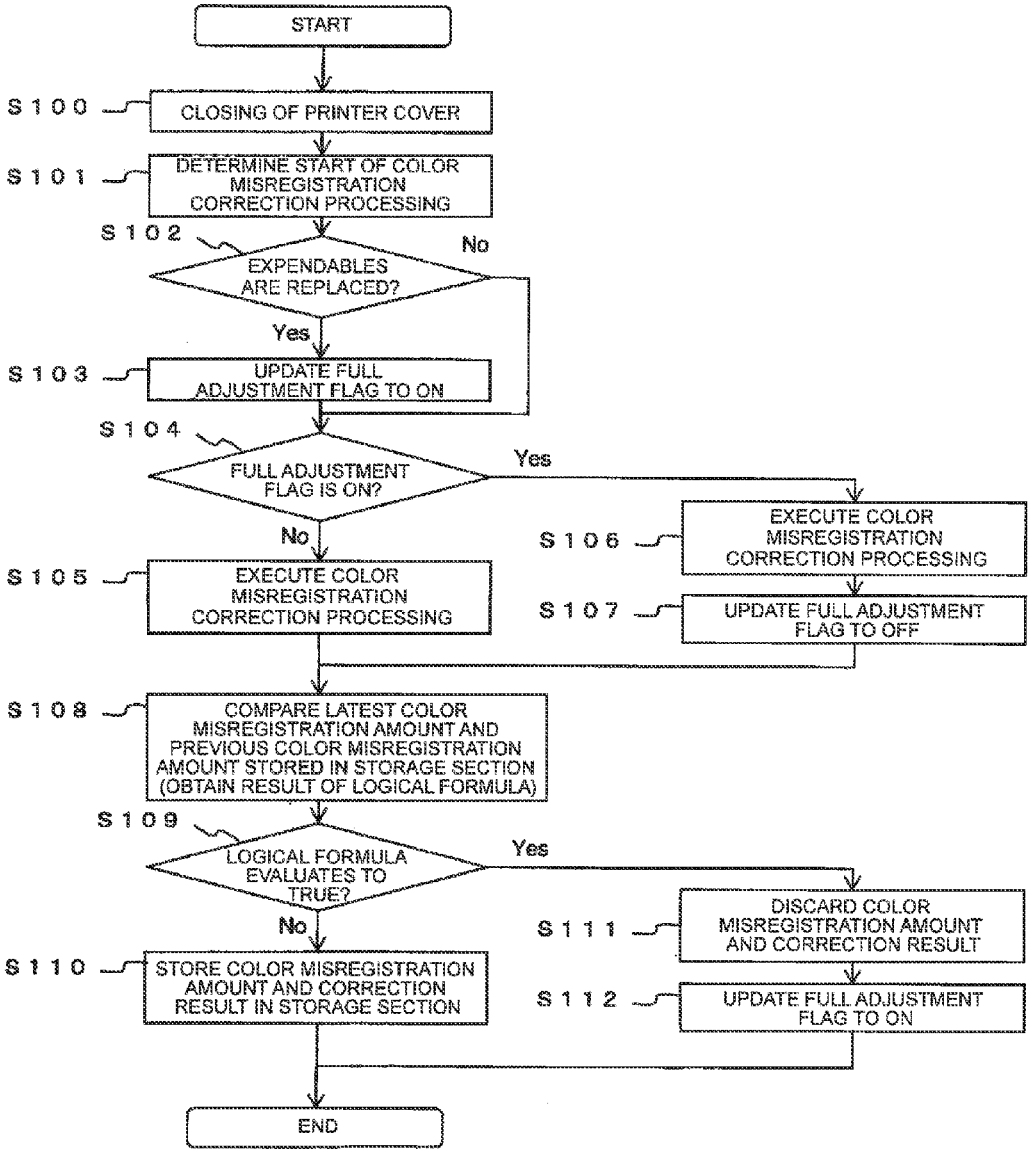
FIG. 8 is a flowchart illustrating an operation upon closing the printer cover in the MFP according to the first embodiment.

FIG. 8 is a flowchart illustrating the operations of MFP 1000 when printer cover opening and closing sensor 34 detects a closing (transition from the open state to the closed state) of printer cover 102. Note that, in the following flowchart, full adjustment flag F to be used in the processing by mechanism controller 53 is flag data (data indicated by any one of the values ON and OFF) stored in storage section 533. Note that an initial value of full adjustment flag F is "OFF".

First, when printer cover 102 is closed (i.e., closed from the open state and shifted to the closed state), printer cover opening and closing sensor 34 detects the closing of printer cover 102. The detection signal is supplied to mechanism controller 53 (S100), from which color misregistration correction execution determination section 532 determines the start of color misregistration correction processing (S101).

Then, upon detection of the closing by printer cover opening and closing sensor 34, expendable supplies sensor 35 also checks if there has been a replacement of expendable supplies (any of toner cartridges 10) (when replacement is detected compared with when printer cover 102 is in the previous closed state) (S102). When the expendable supplies replacement is detected by expendable supplies sensor 35, a detection signal to that effect is also supplied to mechanism controller 53, and mechanism controller 53 updates the value of full adjustment flag F to ON (S103).

Next, mechanism controller 53 checks the value of full adjustment flag F (S104), and performs the operation from Step S105 to be described later when the value of full adjustment flag F is ON and performs the operation from Step S106 to be described later when the value of full adjustment flag F is OFF.

When full adjustment flag F is OFF in Step S104 described above, color misregistration correction control processing section 531 performs color misregistration correction processing (forming detection patterns, detecting a color misregistration amount, and correcting the detected color misregistration amount) (S105).

When full adjustment flag F is ON in Step S104 described above, on the other hand, color misregistration correction control processing section 531 performs color misregistration correction processing (S106) and further updates full adjustment flag F to OFF (S107).

Subsequent to the processing in Step S105 or S107 described above, for each of print mechanisms 2Y, 2M and 2C, mechanism controller 53 assigns the latest detected color misregistration amounts (Xi and Yi) and the previously detected color misregistration amounts (X (i−1) and Y(i−1)) stored in storage section 533 to logical formula (1) described above and determines whether or not logical formula (1) holds (whether or not the logical formula evaluates to True) (S108), and checks the result (S109).

When logical formula (1) evaluates to False for all print mechanisms 2Y, 2M and 2C in Step S109 described above, it can be presumed that a difference in color misregistration amount between all print mechanisms 2Y, 2M and 2C (difference from the previous color misregistration amount) is not more than a predetermined value and that no shock is generated by the closing of scanner unit 200 or the like during the color misregistration correction processing (processing in Step S104 or S105 described above) in MFP 1000. Therefore, in this case, it can be presumed that the color misregistration amount correction processing (processing in Step S104 or S105 described above) is normally finished for all print mechanisms 2Y, 2M and 2C. On the other hand, when logical formula (1) evaluates to True for at least one of print mechanisms 2Y, 2M and 2C, it can be presumed that a difference in color misregistration amount between print mechanisms 2 for which logical formula (1) evaluates to True (difference from the previous color misregistration amount) is larger than the predetermined value and that shock is generated by the closing of scanner unit 200 or the like during the color misregistration correction processing (processing in Step S104 or S105 described above) in MFP 1000. In this case, the color misregistration amount correction processing (the processing in Step S104 or S105 described above) has failed for at least print mechanisms 2 for which logical formula (1) evaluates to True, and another color misregistration correction processing is required.

When logical formula (1) evaluates to False for all print mechanisms 2Y, 2M and 2C in Step S109 described above, color misregistration correction control processing section 531 stores the latest detected color misregistration amounts (Xi and Yi) for all print mechanisms 2Y, 2M and 2C and the correction details (correction control signal to be supplied to LED head interface section 52) corresponding to the color misregistration amount in storage section 533 (S110), and terminates the processing.

On the other hand, when logical formula (1) evaluates to True for at least one of print mechanisms 2Y, 2M and 2C in Step S109 described above, color misregistration correction control processing section 531 discards the latest detected color misregistration amounts (Xi and Yi) for all print mechanisms 2Y, 2M and 2C without storing them in storage section 533 (S111). Then, color misregistration correction execution determination section 532 updates full adjustment flag F to ON (S112), and terminates the processing.

Mechanism controller 53 performs the color misregistration correction processing through the operations described above when printer cover 102 is closed.

Figure 9:
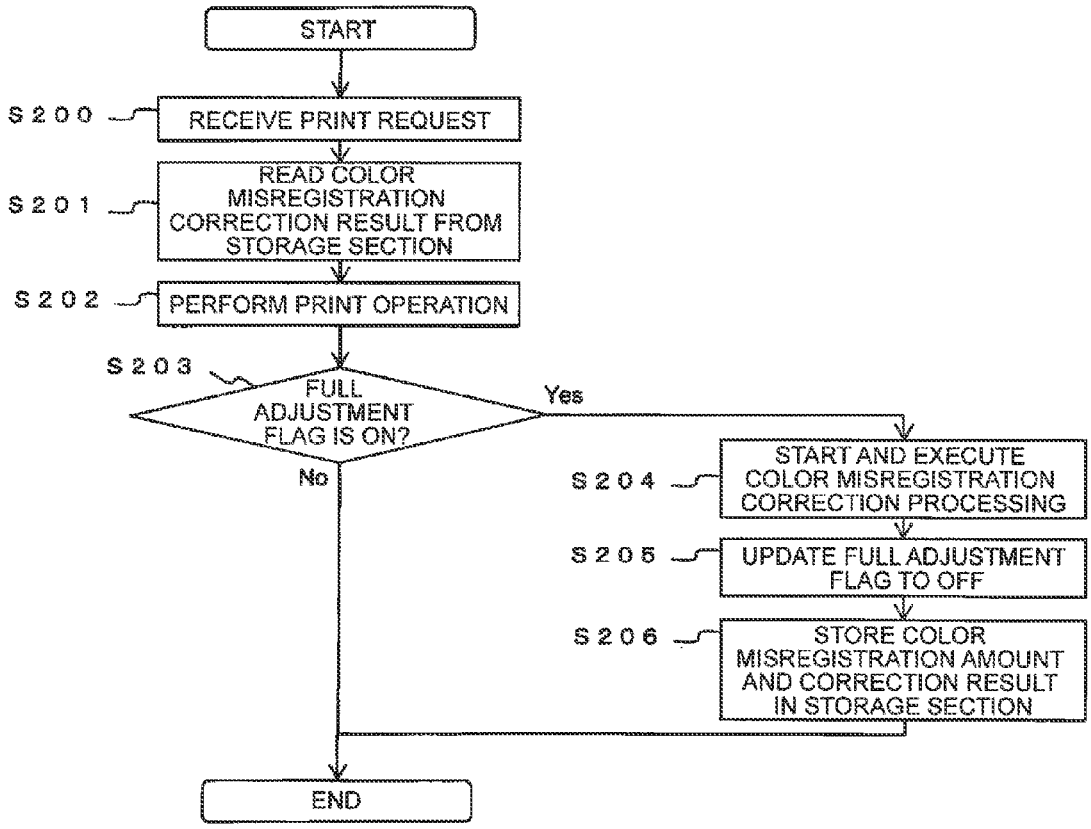
FIG. 9 is a flowchart illustrating an operation in the printing executed by the MFP according to the first embodiment.

Next, with reference to the flowchart of FIG. 9, a description is given of the operations when printer unit 100 (mechanism controller 53) receives a print request (print job) from the host computer or the like after the processing illustrated in the flowchart of FIG. 8 described above.

First, when printer unit 100 (mechanism controller 53) receives a print request from the host computer or the like (S200), mechanism controller 53 reads the correction details (the correction control signal to be supplied to LED head interface section 52) corresponding to the latest color misregistration amounts (Xi and Yi) stored in storage section 533 (S201).

Then, printer unit 100 (mechanism controller 53) performs print control processing (print processing for paper S that is the recording medium) based on the received print request (S202).

Next, mechanism controller 53 (color misregistration correction execution determination section 532) reads and checks full adjustment flag F from storage section 533 (S203). When full adjustment flag F read from storage section 533 indicates OFF, mechanism controller 53 (color misregistration correction execution determination section 532) terminates the processing without performing another color misregistration correction processing.

On the other hand, when full adjustment flag F read from storage section 533 indicates ON, color misregistration correction execution determination section 532 in mechanism controller 53 determines that the color misregistration correction processing is to be executed, and color misregistration correction control processing section 531 executes control related to the color misregistration correction processing (S204).

When the color misregistration correction processing is terminated, color misregistration correction execution determination section 532 in mechanism controller 53 updates full adjustment flag F to OFF (S205) and stores the color misregistration amounts (Xi and Yi) obtained by the latest color misregistration correction processing (the processing in Step S204 described above) and the correction details (correction control signal to be supplied to LED head interface section 52) corresponding to the color misregistration amounts (Xi and Yi) in storage section 533 (S206) before terminating the processing.

Note that the above description is given assuming that the flowchart of FIG. 9 is executed when printer unit 100 (mechanism controller 53) receives a print request (print job) from the host computer or the like (the processing in Step S200 described above) after the execution of the processing illustrated in the flowchart of FIG. 8 described above. However, the flowchart of FIG. 9 may be applied to the case where printer unit 100 (mechanism controller 53) executes a print job held (spooled) before printer cover 102 is closed (except the processing of Step S200 is omitted). One example of such a case is the situation where, after the print job is interrupted because any of toner cartridges 10 goes out of toner during execution of the print processing based on the print job, the operator replaces the toner cartridge 10 (after opening and closing printer cover 102), and then the print job is resumed.

(A-3) Effects of First Embodiment

According to the first embodiment, the following effects can be achieved.

In MFP 1000, even when shock is generated by the opening and closing operation of scanner unit 200 or the like during the color misregistration correction processing to be automatically executed after printer cover 102 is closed, if the difference in color misregistration amount is not less than the predetermined threshold (e.g., when formula (1) described above is satisfied) as a result of a comparison with the previous color misregistration amount (Steps S108 and S109 described above) immediately after the color misregistration correction processing, the color misregistration amount caused by the opening and closing operation of scanner unit 200 is more surely suppressed by re-executing the color misregistration correction control (the processing of Step S204 described above) in the next print operation. Accordingly, in the first embodiment, the color misregistration amount caused by the opening and closing operation of scanner unit 200 can be suppressed without separately providing hardware (sensor) to detect the opening and closing operation of scanner unit 200.

Moreover, the color misregistration correction processing normally takes about 15 seconds to 40 seconds (the time varies depending on the correction details). Therefore, in MFP 1000 of this embodiment, re-execution of the color misregistration correction processing during the print operation is performed after the print operation. Thus, in MFP 1000, a reduction in convenience due to the re-execution of the color misregistration correction processing is suppressed by hastening the print operation start upon re-execution of the color misregistration correction processing.

(B) Second Embodiment

With reference to the drawings, a detailed description is given below of a second embodiment of an image formation apparatus and a method of controlling the image formation apparatus according to the invention. Note that, in the second embodiment, the description is given of an example where the image formation apparatus of the invention is applied to an MFP.

(B-1) Configuration of Second Embodiment

A configuration of MFP 1000A of the second embodiment can be illustrated by the same drawings (FIGS. 1 to 7 described above) as those of the first embodiment. Only differences of MFP 1000A of the second embodiment with the first embodiment are described below.

MFP 1000A of the second embodiment is different from the first embodiment in that printer unit 100 is replaced with printer unit 100A. Also, the second embodiment is different from the first embodiment in that mechanism controller 53 is replaced with mechanism controller 53A.

(B-2) Operations of Second Embodiment

Next, a description is given of the differences of operations by MFP 1000A of the second embodiment from the first embodiment. MFP 1000A of the second embodiment is different from that of the first embodiment only in operations during execution of a print operation after printer cover 102 is closed.

Figure 10:
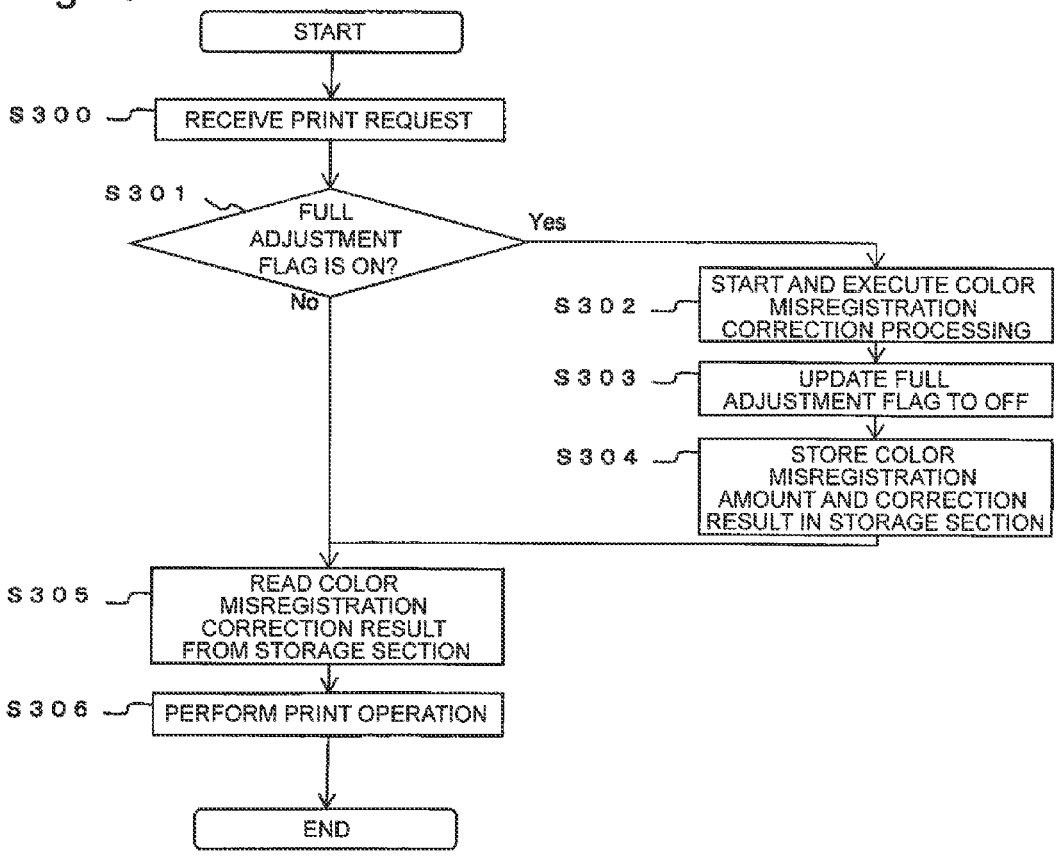
FIG. 10 is a flowchart illustrating an operation in the printing executed by an MFP according to a second embodiment.

In the first embodiment, when printer unit 100 (mechanism controller 53) receives a print request (print job) from the host computer or the like (Step S201), the color misregistration correction processing is performed according to the indication of full adjustment flag F (Steps S203 to S206) after the execution of the print operation (Steps S201 and S202) as illustrated in FIG. 9 described above. In the second embodiment, on the other hand, a flowchart of FIG. 10 illustrates an operation when printer unit 100A (mechanism controller 53A) receives a print request (print job) from a host computer or the like. More specifically, printer unit 100A (mechanism controller 53A) of the second embodiment first performs color misregistration correction processing according to the indication of full adjustment flag F (Steps S301 to S304) and then performs a print operation (Steps S305 and S306) as illustrated in FIG. 10. Note that the processing of Steps S301 to S304 is the same as that of Steps S203 to S206 in the first embodiment. Also, the processing of Steps S305 to S306 is the same as that of Steps S201 to S202 in the first embodiment.

Note that, as in the case of FIG. 9 described above, the processing illustrated in the flowchart of FIG. 10 may be applied to the case where printer unit 100A (mechanism controller 53A) executes a print job held (spooled) before printer cover 102 is closed (except the processing of Step S300 is omitted).

(B-3) Effects of Second Embodiment

Effects of the second embodiment compared with those of the first embodiment are described below.

In the first embodiment, as described above, the print operation is first performed and then the color misregistration correction processing is performed according to the indication of full adjustment flag F. Thus, in MFP 1000 of the first embodiment, the time before the first print starts after printer cover 102 is closed can be shortened. However, MFP 1000 of the first embodiment initially performs the print operation using the value obtained by the previous color misregistration correction executed before closing of printer cover 102. Therefore, there is a possibility that color misregistration correction quality is deteriorated (color misregistration is increased) depending on the level of shock of the apparatus caused by the operation of opening and closing printer cover 102 or scanner unit 200. On the other hand, printer unit 100A (mechanism controller 53A) of the second embodiment performs color misregistration correction processing according to the indication of full adjustment flag F before the print operation. Thus, even though the time before the first print starts after printer cover 102 is closed is increased, the quality of the first print operation can still be improved.

(C) Third Embodiment

With reference to the drawings, a detailed description is given below of a third embodiment of an image formation apparatus and a method of controlling the image formation apparatus according to the invention. Note that, in the third embodiment, the description is given of an example where the image formation apparatus of the invention is applied to an MFP.

(C-1) Configuration and Operations of Third Embodiment

A configuration of MFP 1000B of the third embodiment (except for a configuration of mechanism controller 53B to be described later) can be illustrated by the same drawings (FIGS. 1 to 6 described above) as those of the first and second embodiments. Only the differences of MFP 1000B of the third embodiment from the first and second embodiments are described below.

MFP 1000B of the third embodiment is different from the first embodiment in that printer unit 100 (100A) is replaced with printer unit 100B. Also, the third embodiment is different from the first embodiment in that mechanism controller 53 (53A) is replaced with mechanism controller 53B.

Figure 11:
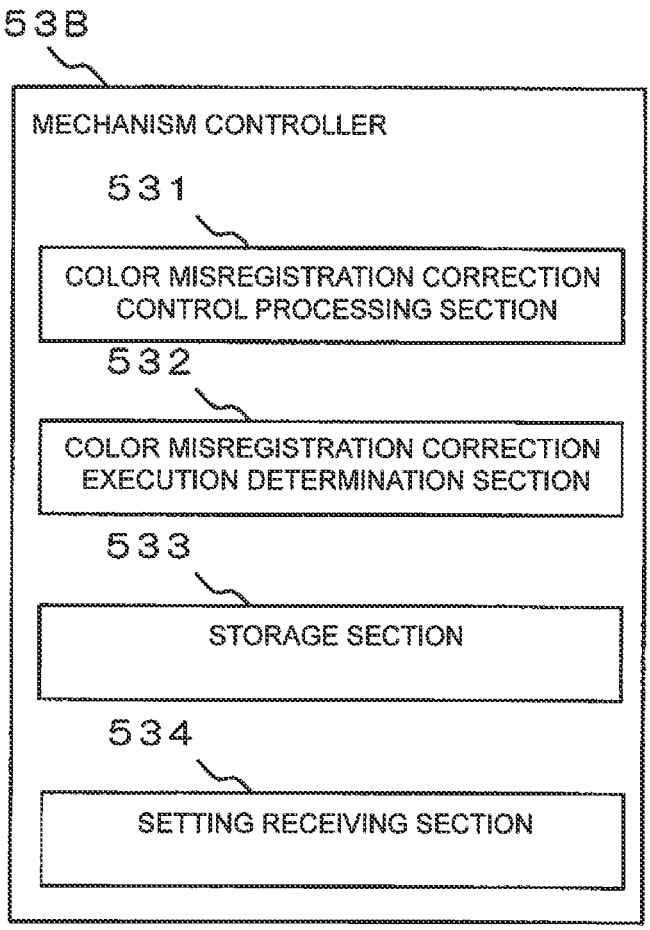
FIG. 11 is a block diagram illustrating a functional configuration of a mechanism control unit according to a third embodiment.

FIG. 11 is an explanatory diagram illustrating a functional configuration of mechanism controller 53B in the third embodiment. As illustrated in FIG. 11, mechanism controller 53B is different from those of the first and second embodiments in that it further includes a setting receiving section 534.

As described above, when receiving a print request (print job), printer unit 100 (mechanism controller 53) of the first embodiment performs the print operation (Steps S201 and S202) and then performs the color misregistration correction processing according to the indication of full adjustment flag F (Steps S203 to S206) as illustrated in FIG. 9 described above. Meanwhile, when receiving a print request (print job), printer unit 100A (mechanism controller 53A) of the second embodiment first performs the color misregistration correction processing according to the indication of full adjustment flag F (Steps S301 to S304) and then performs the print operation (Steps S305 and S306). In other words, in the mechanism controllers 53 and 53A of the first and second embodiments, the order of performing the color misregistration correction processing and the print operation upon receipt of a print request (print job) is fixed. However, mechanism controller 53B of the third embodiment is different from those of the first and second embodiments in being capable of setting an arbitrary order according to an operation from the operator. Setting receiving section 534 can receive the setting of any one of (1) an operation mode to first perform a print operation and then perform color misregistration correction processing (hereinafter referred to as a "first operation mode") and (2) an operation mode to first perform color misregistration correction processing and then perform a print operation (hereinafter referred to as a "second operation mode") from the operator. In the third embodiment, setting receiving section 534 receives the setting of whether to operate MFP 1000 in the first operation mode or in the second operation mode, in response to an operation by the operator on operation display section 201 in scanner unit 200, for example, and stores the set mode in storage section 533.

As described above, in MFP 1000B of the third embodiment, an operation mode control unit is configured using mechanism controller 53B.

(C-2) Effects of Third Embodiment

In the third embodiment as described above, an effect of further improving the convenience can be achieved, in addition to the effects achieved by the first embodiment, since the color misregistration correction processing and the print operation can be performed in an arbitrary order according to the operation by the operator.

(D) Fourth Embodiment

With reference to the drawings, a detailed description is given below of a fourth embodiment of an image formation apparatus and a method of controlling the image formation apparatus according to the invention. Note that, in the fourth embodiment, the description is given of an example where the image formation apparatus of the invention is applied to an MFP.

(D-1) Configuration of Fourth Embodiment

Next, a description is given of the differences of operations of MFP 1000C of the fourth embodiment from the first embodiment.

A configuration of MFP 1000C of the fourth embodiment (except for a configuration of a control system and a configuration of mechanism controller 53C to be described later) can be illustrated by the same drawings (FIGS. 2 to 6 described above) as those of the first and second embodiments. Only the differences of MFP 1000C of the fourth embodiment from the first and second embodiments are described below.

Figure 12:
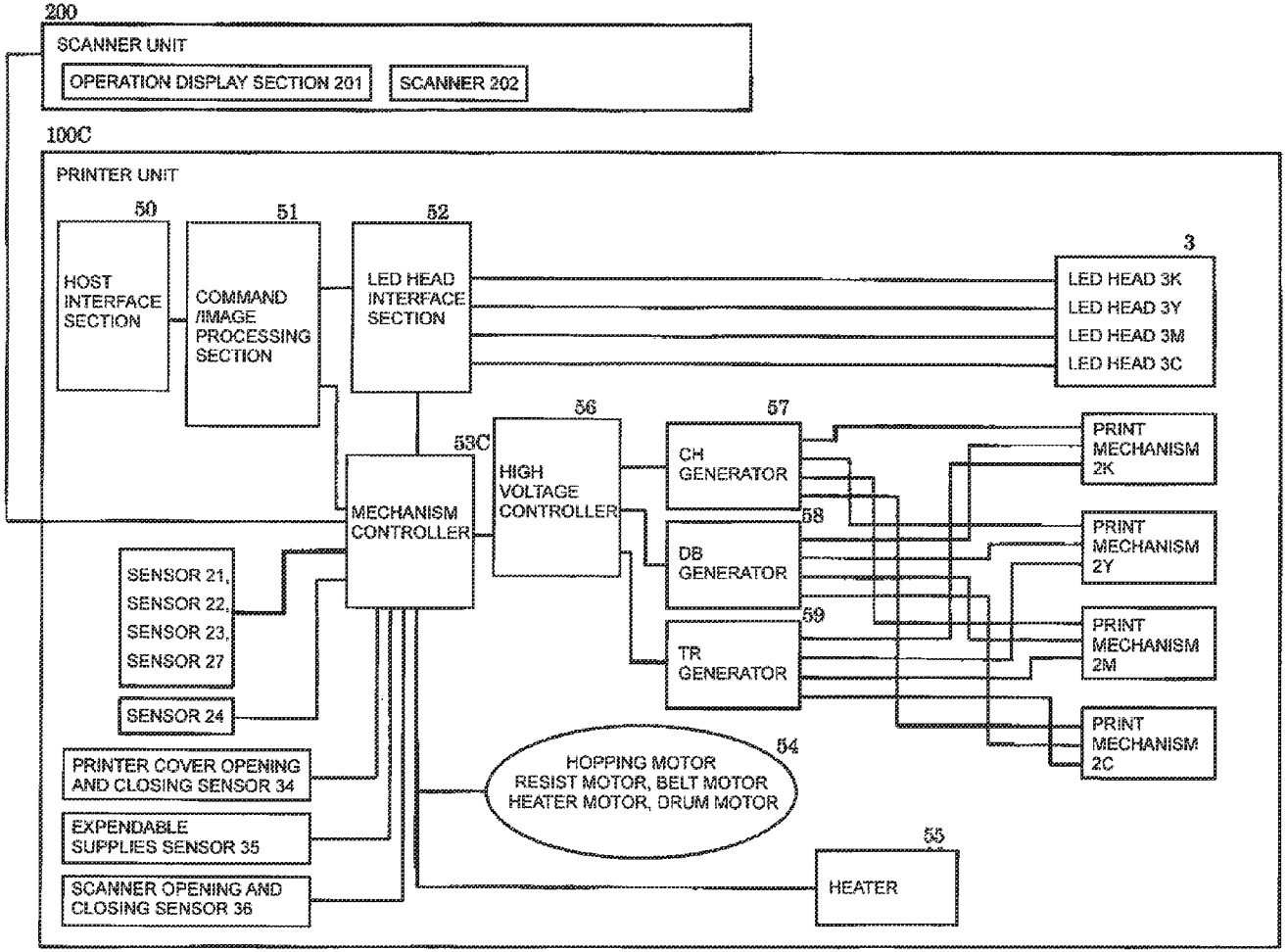
FIG. 12 is a block diagram illustrating a configuration of a control system of an MFP according to a fourth embodiment.

FIG. 12 is a block diagram extracting and illustrating constituent components related to a color misregistration correction function in the control system of MFP 1000C of the fourth embodiment.

MFP 1000C of the fourth embodiment is different from that of the first embodiment in that printer unit 100 is replaced with printer unit 100C. Also, the fourth embodiment is different from the first embodiment in that mechanism controller 53 is replaced with mechanism controller 53C.

Moreover, printer unit 100C is different from that of the first embodiment in further including scanner opening and closing sensor 36 (second opening and closing sensor) to detect open and closed states of scanner unit 200. A detection method of scanner opening and closing sensor 36 is not limited. For example, scanner opening and closing sensor 36 may include a detection mechanism such as a button which is set in a pressed state (ON state) when scanner unit 200 is closed and set in a released state (OFF state) when scanner unit 200 is opened.

Figure 13:
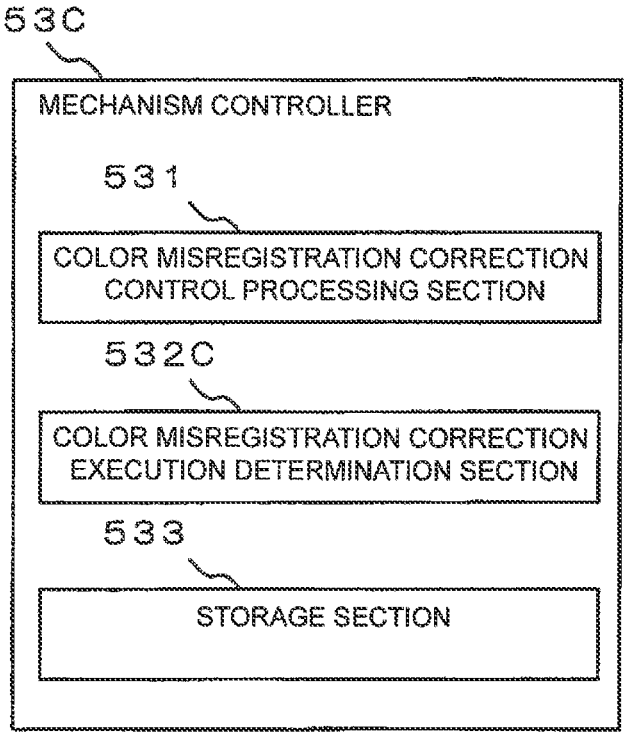
FIG. 13 is a block diagram illustrating a functional configuration of a mechanism control unit according to the fourth embodiment.

Next, an internal configuration of mechanism controller 53C is described with reference to FIG. 13. FIG. 13 is a block diagram illustrating a functional configuration of mechanism controller 53C.

Mechanism controller 53C is different from that of the first embodiment in that color misregistration correction execution determination section 532 is replaced with color misregistration correction execution determination section 532C. Color misregistration correction execution determination section 532C determines the start of the color misregistration correction processing using detection results obtained by not only printer cover opening and closing sensor 34 but also scanner opening and closing sensor 36.

(D-2) Operations of Fourth Embodiment

Figure 14:
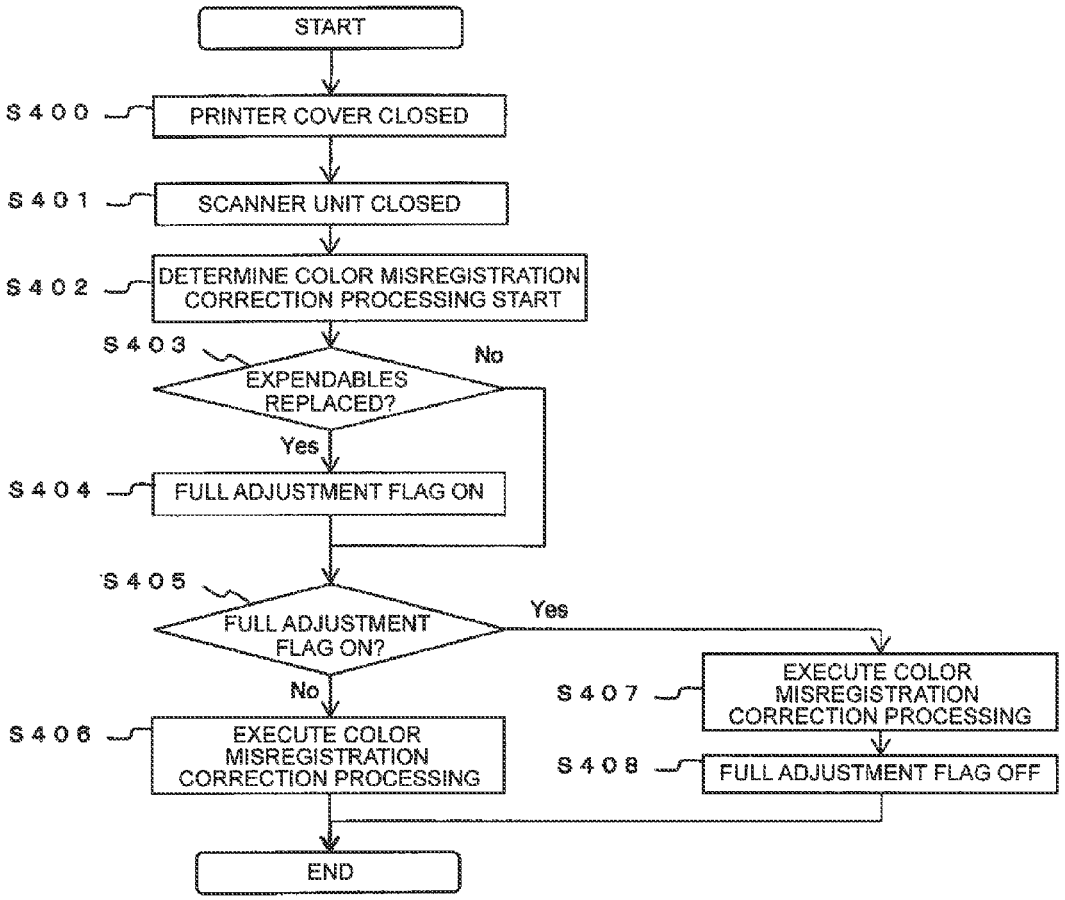
FIG. 14 is a flowchart illustrating an operation upon closing a printer cover and a scanner unit in the MFP according to the fourth embodiment.

Next, a description is given of the differences of operations of MFP 1000C of the fourth embodiment from the first embodiment. FIG. 14 is a flowchart illustrating the operations of MFP 1000C when printer cover opening and closing sensor 34 and scanner opening and closing sensor 36 detect a closing (transition from the open state to the closed state) of printer cover 102 and a closing of scanner unit 200.

First, printer cover 102 is closed from the open state and shifted to the closed state, and printer cover opening and closing sensor 34 detects the closing of printer cover 102. The detection signal is supplied to mechanism controller 53C (S400).

Subsequently, scanner unit 200 is closed from the open state and shifted to the closed state, and scanner opening and closing sensor 36 detects the closing of scanner unit 200 (S401). Then, when the detection signal is supplied to mechanism controller 53C, color misregistration correction execution determination section 532 determines the start of the color misregistration correction processing (S402).

Then, upon detection of the closing of scanner unit 200, expendable supplies sensor 35 also checks if there is a replacement of expendable supplies (S403). When the expendable supplies replacement is detected by expendable supplies sensor 35, a detection signal to that effect is also supplied to mechanism controller 53C, and mechanism controller 53C updates the value of full adjustment flag F to ON (S404).

Next, mechanism controller 53C checks the value of full adjustment flag F (S405), and performs the operation from Step S406 to be described later when the value of full adjustment flag F is ON and performs the operation from Step S407 to be described later when the value of full adjustment flag F is OFF.

When full adjustment flag F is ON in Step S405 described above, color misregistration correction control processing section 531 performs color misregistration correction processing (the processing of detecting a color misregistration amount and correcting the detected color misregistration amount) (S406).

When full adjustment flag F is ON in Step S405 described above, on the other hand, color misregistration correction control processing section 531 performs color misregistration correction processing (S407) and also updates full adjustment flag F from ON to OFF (S408) before terminating the processing.

Mechanism controller 53C performs the color misregistration correction processing through the operations described above when printer cover 102 and scanner unit 200 are closed. Note that, in the flowchart of FIG. 14, the processing related to full adjustment flag F (Steps S403 to S405, S407 and S408) may be omitted.

(D-3) Effects of Fourth Embodiment

MFP 1000C of the fourth embodiment can suppress the color misregistration due to the shock caused by closing of scanner unit 200 without re-executing the color misregistration correction processing during the print operation, unlike the first to third embodiments where the color misregistration correction processing is executed (Step S407) after printer cover 102 and scanner unit 200 are closed. However, in the fourth embodiment, scanner opening and closing sensor 36 to detect the opening and closing of scanner unit 200 needs to be additionally provided. Therefore, the MFP of the fourth embodiment requires more hardware cost compared with those of the first to third embodiments.

(E) Other Embodiments

The invention is not limited to the above embodiments, but may include modified embodiments as illustrated below.

(E-1)

In the above embodiments, the description is given of the example where the image formation apparatus of the invention is applied to the MFP including the printer unit and scanner unit. However, the invention may be applied to other image formation apparatuses, such as a printer and a copying machine, including a second opening and closing body (e.g., another opening and closing body such as a paper feed cassette, a paper feed tray and a paper discharge tray) that can be accessed when the printer cover (first opening and closing body) of the printer unit is closed.

(E-2)

The above description is given assuming that the MFP according to each of the embodiments has the configuration to correct the color misregistration in the main scanning direction and sub-scanning direction. However, the MFP maybe configured to also correct a color misregistration in an oblique direction as in Patent Document 1. In such a case, the mechanism controller needs to also store a color misregistration amount in the oblique direction in addition to those in the main scanning direction and sub-scanning direction. Moreover, in this case, the mechanism controller needs to obtain a difference from the previous color misregistration amount in the main scanning direction, sub-scanning direction or oblique direction, and to change logical formula (1) described above to a logical formula returning True when there is a difference not less than a threshold in any one of the main scanning direction, sub-scanning direction and oblique direction.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image formation section including image formation units configured to form images on a medium; and a mechanism controller configured to control the image formation section and cause the image formation section to perform image formation, wherein the mechanism controller performs image formation misregistration amount detection processing that comprises causing each of the image formation units in the image formation section to form a first misregistration amount detection pattern, and computing a first image formation misregistration amount by comparing each of the first misregistration amount detection patterns formed by each of the image formation units that output a non-black color with one of the first misregistration amount detection patterns formed by one of the image formation units that outputs a black color, comparison processing that comprises comparing the first image formation misregistration amount with a previous image formation misregistration amount that is obtained and stored prior to obtaining the first image formation misregistration amount, and image formation misregistration correction processing that comprises, each time a door of the image formation apparatus has been opened when a print job is in progress and has not yet completed:

(a) when a difference between the previous image formation misregistration amount and the first image formation misregistration amount is larger than a predetermined value, causing each of the image formation units to complete the print job that is in progress according to the previous image formation misregistration amount, and causing, after completion of the print job that is in progress and that is being printed according to the previous image formation misregistration amount, each of the image formation units in the image formation section to form a second misregistration amount detection pattern, and obtaining a second image formation misregistration amount based on a detection result obtained by detecting a reflection of the second misregistration amount detection pattern, and correcting the image formation misregistration according to the second image formation misregistration amount for future print jobs to be processed by the image formation apparatus after the print job that is in progress, and (b) when the difference between the previous image formation misregistration amount and the first image formation misregisration amount is not more than the predetermined value, correcting the image formation misregistration according to the first image formation misregistration amount.

2. The image formation apparatus according to claim 1, wherein the mechanism controller includes a correction control processing section configured to detect the image formation misregistration amount and correct the image formation misregistration according to the detected image formation misregistration amount.

3. The image formation apparatus according to claim 1, wherein the mechanism controller includes a correction execution determination section configured to determine when to start the image formation misregistration correction processing.

4. The image formation apparatus according to claim 1, wherein the mechanism controller includes a storage section configured to store correction data based on the image formation misregistration amount.

5. The image formation apparatus according to claim 4, wherein the storage section stores a necessity indicator on whether or not to perform the image formation misregistration correction processing based on the second image formation misregistration amount.

6. The image formation apparatus according to claim 5, wherein the mechanism controller is configured to perform the image formation misregistration correction processing based on the necessity indicator.

7. The image formation apparatus according to claim 1, wherein the image formation misregistration amount is a color misregistration amount that is an amount of misregistration in print position among the image formation units in the image formation section.

8. The image formation apparatus according to claim 1, further comprising:

an apparatus main body; and a cover openably and closably provided to the apparatus main body.

9. The image formation apparatus according to claim 8, wherein the mechanism controller is configured to perform the image formation misregistration amount detection processing upon a detection of a closing of the cover.

10. The image formation apparatus according to claim 1, further comprising:

a printer unit including the image formation section;

a scanner unit configured to read a document; and a connection unit configured to connect the printer unit with the scanner unit.

11. The image formation apparatus according to claim 10, wherein the scanner unit is rotatable relative to the printer unit through the connection unit.

12. An image formation method of performing image formation using an image formation section including image formation units configured to form images on a medium, the method comprising:

image formation misregistration amount detection processing of forming a first misregistration amount detection pattern using the image formation section and obtaining a first image formation misregistration amount by comparing each of the first misregistration amount detection patterns formed by each of the image formation units that outputs a non-black color with one of the first misregistration amount detection patterns formed by one of the image formation units that outputs a black color, comparison processing that comprises comparing the first image formation misregistration amount with a previous image formation misregistration amount that is obtained and stored prior to obtaining the first image formation misregistration amount, and image formation misregistration correction processing of, each time a door of the image formation apparatus has been opened when a print job is in progress and has not yet completed:

(a) when a difference between the previous image formation misregistration amount and the first image formation misregistration amount is larger than a predetermined value, causing each of the image formation units to complete the print job that is in progress according to the previous image formation misregistration amount, and forming, after completion of the print job that is in progress and that is being printed according to the previous image formation misregistration amount, a second misregistration amount detection pattern using the image formation section, and obtaining a second image formation misregistration amount based on a detection result obtained by comparing one of the second misregistration amount detection pattern that is formed by the one of the image formation units with others of the second misregistration amount detection patterns that are formed by the others of the image formation units, and correcting the image formation misregistration according to the second image formation misregistration amount for future print jobs to be processed by the image formation apparatus after the print job that is in progress, and (b) when the difference between the previous image formation misregistration amount and the first image formation misregisration amount is not more than the predetermined value, correcting the image formation misregistration according to the first image formation misregistration amount.

* * * * *